US010750607B2

(12) United States Patent
Tanabe

(10) Patent No.: US 10,750,607 B2
(45) Date of Patent: Aug. 18, 2020

(54) COMPACT STANDING-WAVE LINEAR ACCELERATOR STRUCTURE

(71) Applicant: AET, Inc., Kawasaki, Kanagawa (JP)

(72) Inventor: Eiji Tanabe, Kawasaki (JP)

(73) Assignee: AET, INC., Kawasaki (JP)

( * ) Notice: Subject to any disclaimer, the term of this patent is extended or adjusted under 35 U.S.C. 154(b) by 0 days.

(21) Appl. No.: 16/215,641

(22) Filed: Dec. 11, 2018

(65) Prior Publication Data

US 2020/0187345 A1 Jun. 11, 2020

(51) Int. Cl.
*H05H 9/04* (2006.01)
*H05H 7/18* (2006.01)

(52) U.S. Cl.
CPC ..... *H05H 9/048* (2013.01); *H05H 7/18* (2013.01)

(58) Field of Classification Search
None
See application file for complete search history.

(56) References Cited

U.S. PATENT DOCUMENTS 3,546,524 A 12/1970 Stark
4,155,027 A 5/1979 Schriber et al.
4,651,057 A 3/1987 Uetomi et al.
4,988,919 A * 1/1991 Tanabe ..... H05H 7/18 313/360.1
6,316,876 B1 * 11/2001 Tanabe ..... H05H 7/18 315/5.39
6,856,105 B2 2/2005 Yao et al.
6,864,633 B2 3/2005 Trail et al.
7,112,924 B2 9/2006 Hanna
7,339,320 B1 3/2008 Meddaugh et al.
7,397,206 B2 7/2008 Yao
7,400,093 B2 7/2008 Salop et al.
2002/0175293 A1 * 11/2002 Whitham ..... H01J 3/02 250/396 R
2009/0140177 A1 * 6/2009 Whittum ..... H05H 9/04 250/493.1
2010/0207553 A1 * 8/2010 Alimov ..... H05H 9/04 315/505
2010/0289436 A1 * 11/2010 Alimov ..... H05H 9/04 315/505

(Continued)

OTHER PUBLICATIONS

C. J. Karzmark, Craig S. Nunan, and Eiji Tanabe, "Microwave Accelerator Structures", Chapter 4 of Medical Electron Accelerators, Sep. 1, 1992, pp. 67-87, McGraw-Hill, New York.

*Primary Examiner* — Henry Luong
(74) *Attorney, Agent, or Firm* — Isshiki International Law Office; Joseph P. Farrar, Esq.

(57) ABSTRACT

A standing-wave linear accelerator structure has an electron gun; a first cavity axially adjacent to the electron gun, into which electrons are injected directly from the electrode gun; a pancake cavity disposed adjacent to the electron gun on a side of the first cavity opposite the electron gun; and a plurality of accelerating cavities including both on-axis cavities and side-coupled cavities, disposed serially after the at least one pancake cavity, to accelerate electrons injected from the electron gun through a central aperture formed in each of the on-axis cavities. The first cavity and the pancake cavity together form a buncher cavity. The accelerator structure omits the prebuncher and buncher cavities while retaining their functions.

9 Claims, 7 Drawing Sheets

(56) References Cited

U.S. PATENT DOCUMENTS

2011/0216886 A1* 9/2011 Ho ..... H05H 7/12
378/137
2014/0079189 A1* 3/2014 Miyamoto ..... H05H 9/044
378/138

* cited by examiner c = VELOCITY OF LIGHT
λ = WAVE LENGTH

SIDE-COUPLED STRUCTURE

HIGHER SHUNT IMPEDANCE

ON-AXIS COUPLED STRUCTURE

LOWER SHUNT IMPEDANCE

COMPACT STANDING-WAVE LINEAR ACCELERATOR STRUCTURE

BACKGROUND

Technical Field

Aspects of this disclosure relate to a standing-wave linear accelerator, and more particularly, to a compact standing-wave linear accelerator structure using a combination of on-axis accelerating cavities and side-coupled cavities and which omits a prebuncher and buncher cavities while retaining the prebuncher and buncher functions.

Related Art

Microwave linear accelerators have found widespread medical and industrial applications. Linear accelerators take a beam of electrons injected from an electron gun and use an electromagnetic field applied to a string of cavity resonators coupled together axially in series along the beam axis (that is, along the longitudinal axis of the accelerator structure) to accelerate the injected electrons to nearly the speed of light.

Accelerators are of two basic types: Traveling-wave and standing-wave. Traveling-wave accelerators use traveling wave fields to accelerate the electrons, with the electromagnetic wave moving in one direction through the structure and an electron bunch travelling with it. In contrast, standing-wave accelerators have both ends shorted so that the electromagnetic power is reflected back and forth within the structure to create a standing wave that accelerates the electron bunch forward.

In general, traveling-wave accelerators are more widely used in research fields due to their simpler structure, less stringent construction tolerances, and relative insensitivity to energy variations. By contrast, standing-wave accelerators are usually more suitable for medical and industrial applications due to their shorter length, higher efficiency, and greater beam stability under temperature variations.

Both types of accelerators often make use of a prebuncher (or re-entrant) cavity into which the electron gun injects electrons, positioned next to the gun and immediately downstream from it, followed by a drift space. If a prebuncher cavity is not used, many of the injected electrons are accelerated backward towards the electron gun and often destroy the electron gun cathode. This effect is often called back heating of the electron gun. The microwave electric field in the prebuncher cavity alternately accelerates some electrons and decelerates others, depending on the phase of the applied microwave energy. The effect is to bunch the electrons together as these pass through the prebuncher cavity and drift space. Tight bunching of the electrons provides the optimal beam characteristics and offers a tight electron energy spectrum as well as the efficient stable operation needed for compact accelerator applications in particular.

A limiting factor is that the device size limits the locations where an accelerator can be used, particularly those employing side-coupled cavities. This limitation is especially critical in medical and industrial applications, where space maybe limited.

In addition, a problem with conventional linear accelerator structures is an inefficient rate of electron capture, with a consequent heavy back-bombardment of uncaptured electrons and significant damage to the electron gun as a result.

SUMMARY

Embodiments of the present disclosure described herein provide a novel compact standing-wave accelerator that eliminates the prebuncher cavity and uses a buncher cavity, a very thin pancake cavity, and a first main accelerator cavity to function as a prebuncher and buncher, thereby providing a more compact accelerator having a very short length of 30 cm or less.

More specifically, embodiments of the present disclosure combine the buncher cavity with the first of the accelerator cavities via a pancake cavity in a single structure that omits the prebuncher and obviates the need for a side-coupled cavity at that part of the accelerator.

According to embodiments of the present disclosure, a standing-wave linear accelerator structure includes an electron gun; a first cavity; a pancake cavity disposed adjacent to the electron gun on a side of the first cavity opposite the electrode gun, the first cavity and the pancake cavity together functioning as an electron buncher; and a plurality of accelerating cavities including both on-axis coupled cavities and side-coupled cavities, disposed serially after the at least one pancake cavity, configured to accelerate electrons injected from the electron gun through a central aperture formed in each of the on-axis cavities. The accelerator structure of this embodiment omits the prebuncher and buncher cavities while retaining their functions. As a result, the overall accelerator length is shortened.

In addition, the reduced electromagnetic field results in very tight and efficient electron bunching and capturing, and offers a very tight spectrum of the resultant accelerated electrons, while minimizing the electron back-bombardment and providing protection for the electron gun, thereby extending the working life of the electron gun.

BRIEF DESCRIPTION OF THE DRAWINGS

A more complete appreciation of the disclosure and many of the attendant advantages thereof may be obtained as the same becomes better understood by reference to the following detailed description when considered in connection with the accompanying drawings, wherein.

Figure 1:
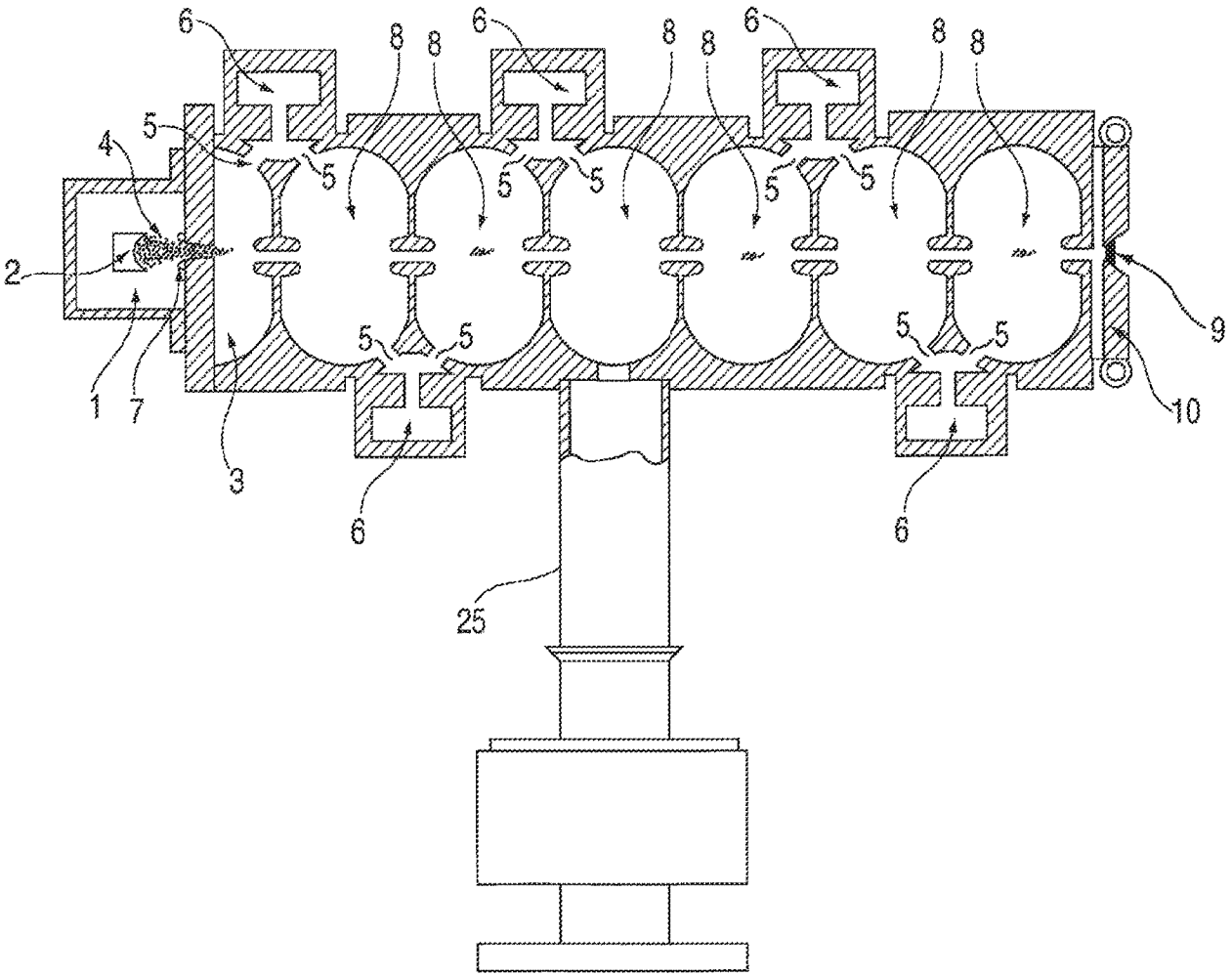
FIG. 1 RELATED ART
FIG. 1 is a sectional side view of a standard side-coupled standing-wave accelerator structure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

One or more embodiments of the present disclosure are described below with reference to the drawings. It is to be noted that although certain specific terminology is employed for the sake of clarity, the present disclosure is not limited to the terminology so selected and it is to be understood that each specific element includes all technical equivalents that have a similar function, operate in a similar manner, and achieve a similar result. As used herein, the singular forms "a", "an", and "the" are intended to include the plural forms as well, unless the context clearly indicates otherwise.

FIG. 1 shows a standard side-coupled standing-wave accelerator structure 100, used in most compact medical and industrial accelerators. This type of accelerator has enjoyed widespread use due to its high shunt impedance. In the accelerator 100 illustrated in FIG. 1, the excited electrons on the cathode 2 within electron gun 1 are accelerated by a voltage applied between the cathode 1 and an additional anode 7. The electrons 4 are then injected into a first cavity 3 whose length is half the length of the main accelerator cavities 8. Electron velocity is modulated by a microwave field applied via an input waveguide 25 through apertures 5 between the side-coupled cavities 6 and every other main accelerator cavity 8. Reference numeral 9 denotes a target (typically a heavy metal such as tungsten) and 10 denotes a heat sink.

Figure 6A:
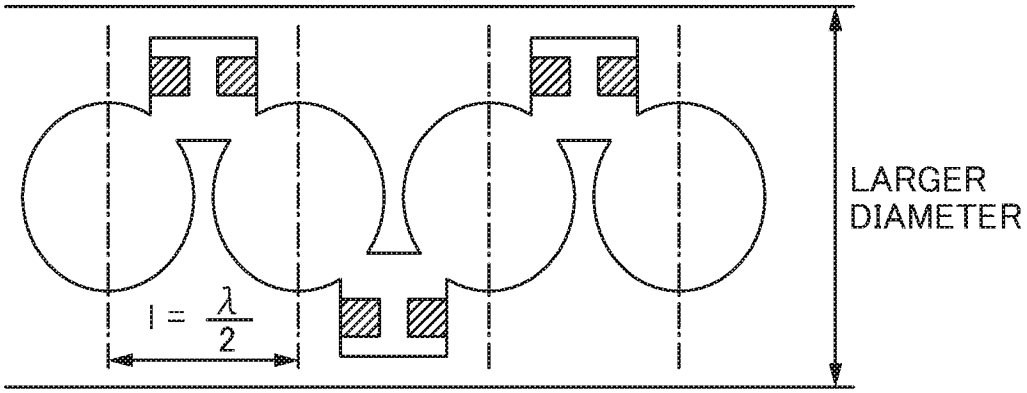
FIG. 6A is a schematic illustration of a side-coupled accelerator structure.
Figure 6B:
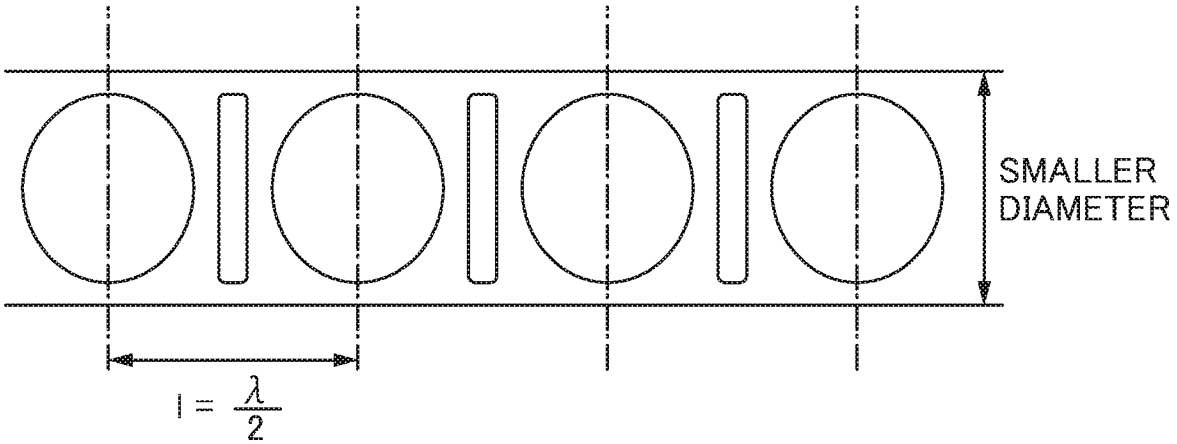
FIG. 6B is a schematic illustration of an on-axis structure.

This side-coupled configuration eliminates the need for a long travelling wave accelerator or bend magnet, and permits use of an extremely short in-line (on-axis) accelerator, but at the cost of requiring substantial radial space. For context, FIGS. 6A and 6B show a schematic comparison of side-coupled structure and the later-described on-axis coupled structure. Note the larger diameter (radial) dimension of the side-coupled structure compared to the on-axis structure.

The standard side-coupled standing-wave accelerator structure 100 is relatively simple, insofar as all the cavities with the exception of the first cavity 3 are the same length and therefore the intensity of the electric field applied is the same from the first cavity through the last, over the entire length of the accelerator. This simplicity of structure, however, has a cost in a lack of efficiency in capturing (bunching) the electrons, with a consequent heavy back-bombardment of uncaptured electrons as a result, in the form of high-energy X-rays directed away from the target. At the same time, the structure will not provide tight bunching of electrons at the end of the accelerator, and as a result, the output beam spectrum will not be sharp enough.

Back-bombardment degrades the electron gun and produces high temperatures of some 2,000° C., necessitating some sort of protection for both the operator and the gun, of which the latter must then be replaced frequently.

Figure 2:
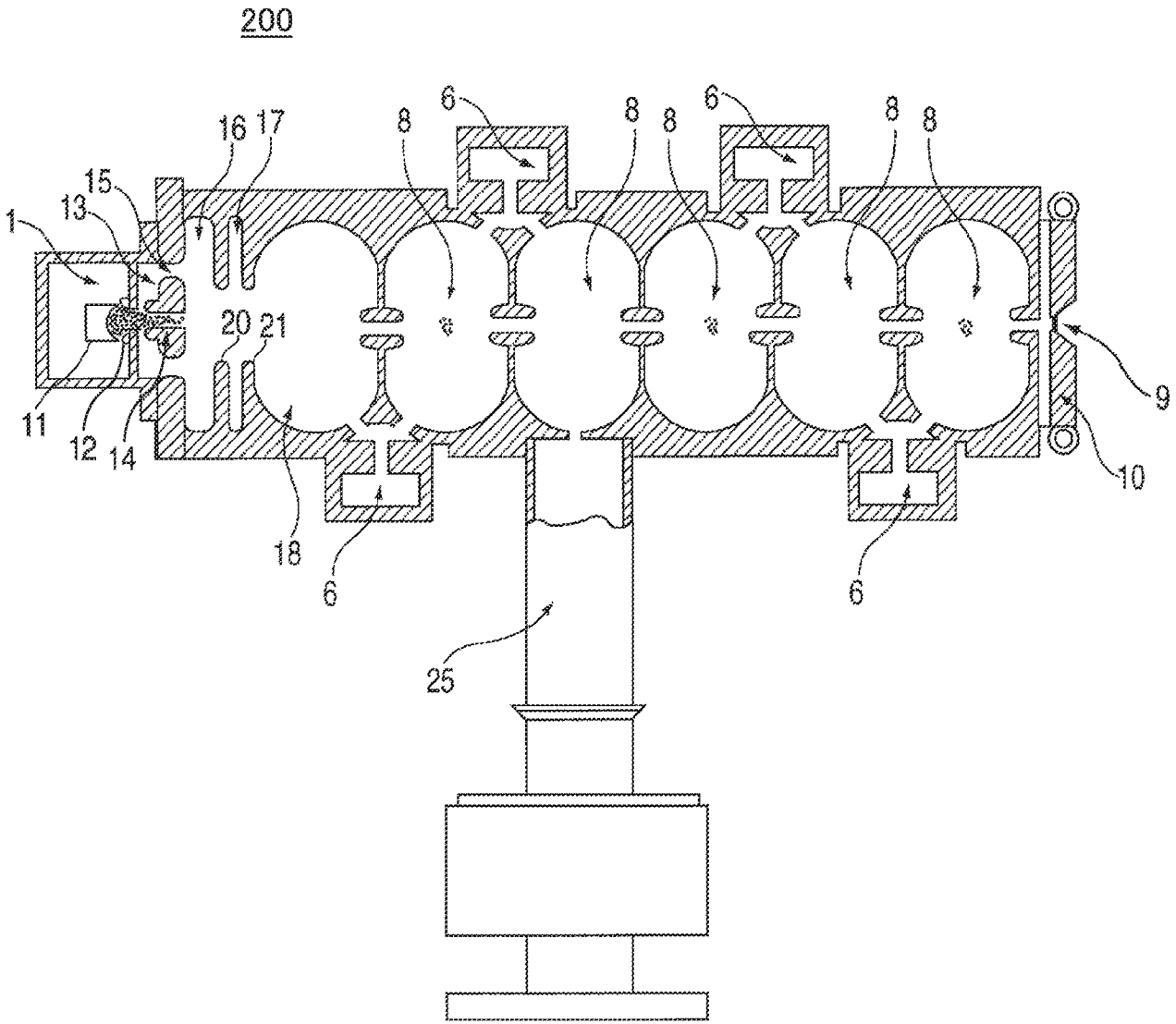
FIG. 2 RELATED ART
FIG. 2 is a sectional side view of a hybrid structure employing both on-axis and side-coupled cavities with prebuncher cavity.

For this reason an electron prebuncher cavity may be used in order to increase electron capture and bunching efficiency (see, for example, U.S. Pat. No. 6,316,876 B1). Such a structure is illustrated in FIG. 2, which shows an accelerator 200 with a hybrid structure employing both on-axis cavities and side-coupled cavities. It should be noted that parts or elements of the accelerator 200 that are the same as those illustrated in FIG. 1 are given the same reference numerals and a description thereof omitted. The on-axis cavities 16, 17 and 18 are electrically coupled to each other through coupling apertures 20 and 21, having different sizes to reduce the electromagnetic field within a first (bunching) cavity 16. The side-coupled cavities 6 are magnetically coupled to the on-axis cavities 8 via apertures.

Although an on-axis structure is less efficient than a side-coupled structure, this loss in efficiency is offset in part by using them only for injecting the electrons and bunching them together, with little acceleration. Moreover, this hybrid structure combining on-axis cavities with side-coupled cavities requires less longitudinal (axial) space because the side cavities must be spaced two on-axis cavities apart. Eliminating a side-coupling cavity thus allows the accelerator to be made shorter than a conventional side-coupled accelerator structure.

In the accelerator 200 illustrated in FIG. 2, the excited electrons on the cathode 11 within the electron gun 1 are accelerated by a voltage applied between the cathode 11 and an additional anode 12. The electrons are injected first into a prebuncher cavity 13 whose length is shorter than the length of the first accelerator cavity 16. Electron velocity is modulated by a microwave field applied through aperture 15 between the first accelerator cavity 16 and the prebuncher cavity 13. Electrons traveling through the beam aperture 14 are prebunched and injected into the first accelerator cavity 16. Standing waves are induced in the accelerator cavities by microwave energy applied through apertures connecting the side-coupled accelerator cavities to the on-axis accelerator cavities.

A disk-shaped coupling cavity 17 (also called a pancake cavity) that couples the first cavity 16 with the adjacent accelerator cavity 18 has no accelerating field, thereby allowing the electrons accelerated by the microwave electric field in the first cavity 16 to further bunch together and then be injected into the first main accelerator cavity 18. Optimal electron acceleration characteristics are obtained with appropriate gun voltage (approximately 25 kV), drift distance (approximately 16 mm), and modulating power (approximately 5 kW).

Conventionally, the average electromagnetic field required to accelerate the electrons is approximately 20 MV/m. However, by adopting a structure in which the prebuncher and buncher cavities are eliminated but their functions retained using a different structure combining a first low-acceleration cavity, a thin pancake cavity, and a first main accelerator cavity, the electrons can be injected directly into the first low-acceleration cavity. This arrangement enables the accelerator device length to be kept relatively short for a more compact structure. This benefit is particular helpful in medical applications, where space may be limited. Such a structure and its effects are illustrated in FIG. 3 to FIG. 5.

Figure 3:
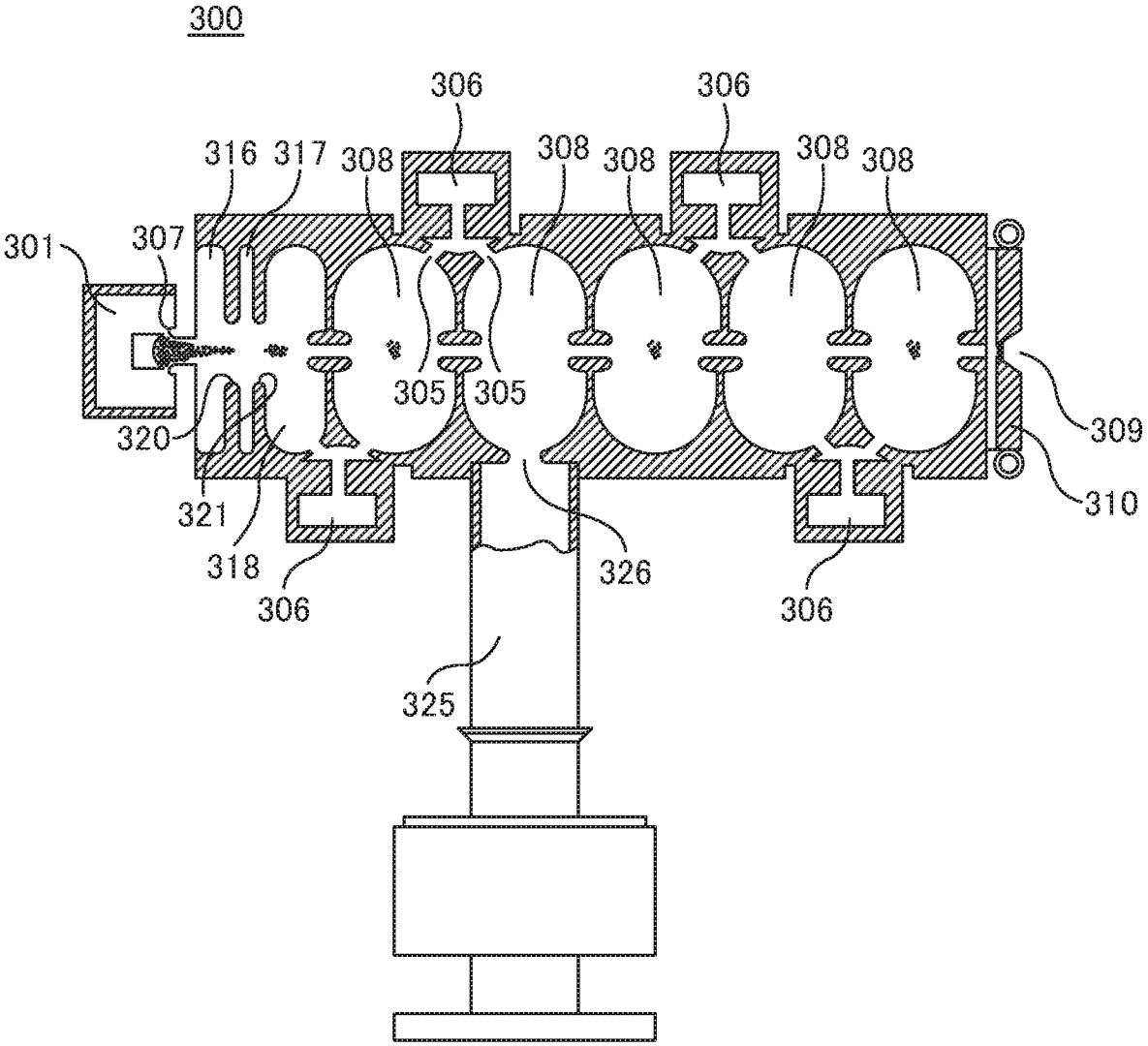
FIG. 3 is a sectional side view of a standing-wave linear accelerator structure according to an embodiment of the present disclosure.

FIG. 3 shows a standing-wave linear accelerator structure 300 according to the present disclosure. In the accelerator 300 illustrated in FIG. 3, electrons from the electron gun 301 are injected directly into a first, low-acceleration, pancake-like cavity 316 having a diameter (i.e., the dimension perpendicular to the paper on which the figure is drawn) similar to the diameter of the main accelerator cavities 308. Standing waves are induced in the accelerator cavities by microwave energy applied through apertures connecting the side-coupled accelerator cavities 306 to the main accelerator cavities 308, as described below. The side-coupled cavities 306 are magnetically coupled to the main cavities 308, so that adjacent main cavities 308 are magnetically coupled to each other through the adjoining side cavities 306. Reference numeral 309 denotes a target and 310 denotes a heat sink. Reference numeral 325 denotes the rf energy input waveguide, which provides the rf power through a waveguide coupling aperture 326.

This embodiment of the present disclosure omits a prebuncher (re-entrant) cavity. Instead, the function of bunching the electrons, which would ordinarily be performed by the prebuncher, is carried out in the first pancake-like cavity 316, which, in the present embodiment, is coupled to the single adjacent thin pancake cavity 317 through aperture 320 as shown in FIG. 3. The first cavity 316, together with the adjacent thin pancake cavity 317, functions as an electron buncher. Modulation of a supplied electromagnetic field within the first cavity bunches together electrons injected thereinto directly from the electron gun, without passing through a prebuncher.

That is, the pancake cavity 317 is connected electrically to the adjacent first cavity 316 through aperture 320 upstream, and is connected downstream electrically to the first main accelerator cavity 318 through aperture 321, again as shown in FIG. 3. Note that there is no side-coupled cavity at the juncture between the pancake cavity 317 and the first accelerator 316 cavity, thus both simplifying the structure at this location and shortening the overall length of the accelerator.

In the present embodiment, the coupling between the first cavity 316 and the first main accelerator cavity 318 is accomplished using the central apertures 320 and 321 as described above. With the central apertures, the accelerating field in the cavities can be varied by giving the apertures different diameters.

Figure 4A:
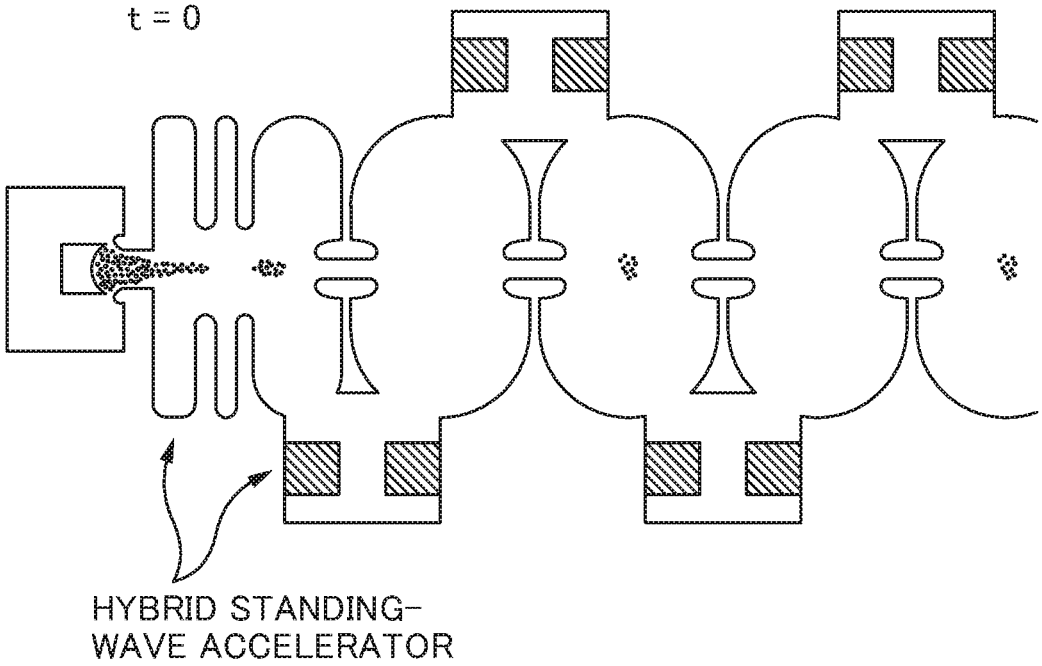
FIG. 4A is an enlarged schematic partial view of the accelerator structure illustrated in FIG. 3, illustrating electron bunching occurring at predetermined time t=0.
Figure 4B:
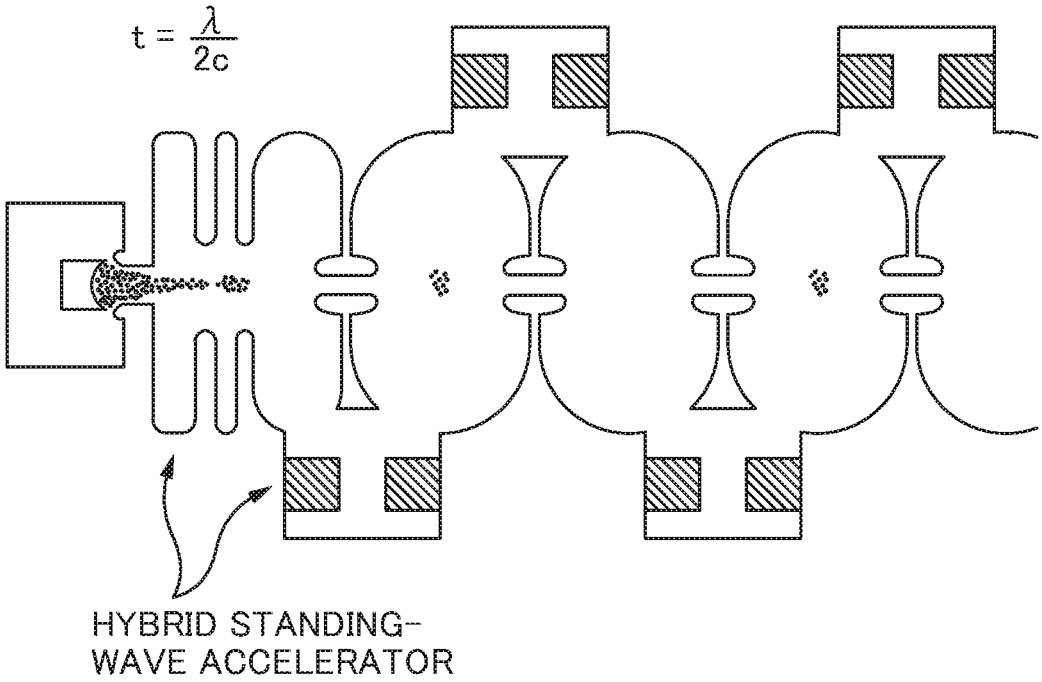
FIG. 4B is an enlarged schematic partial view of the accelerator structure illustrated in FIG. 3, illustrating electron bunching occurring at time $t=\lambda/2c$.
Figure 5:
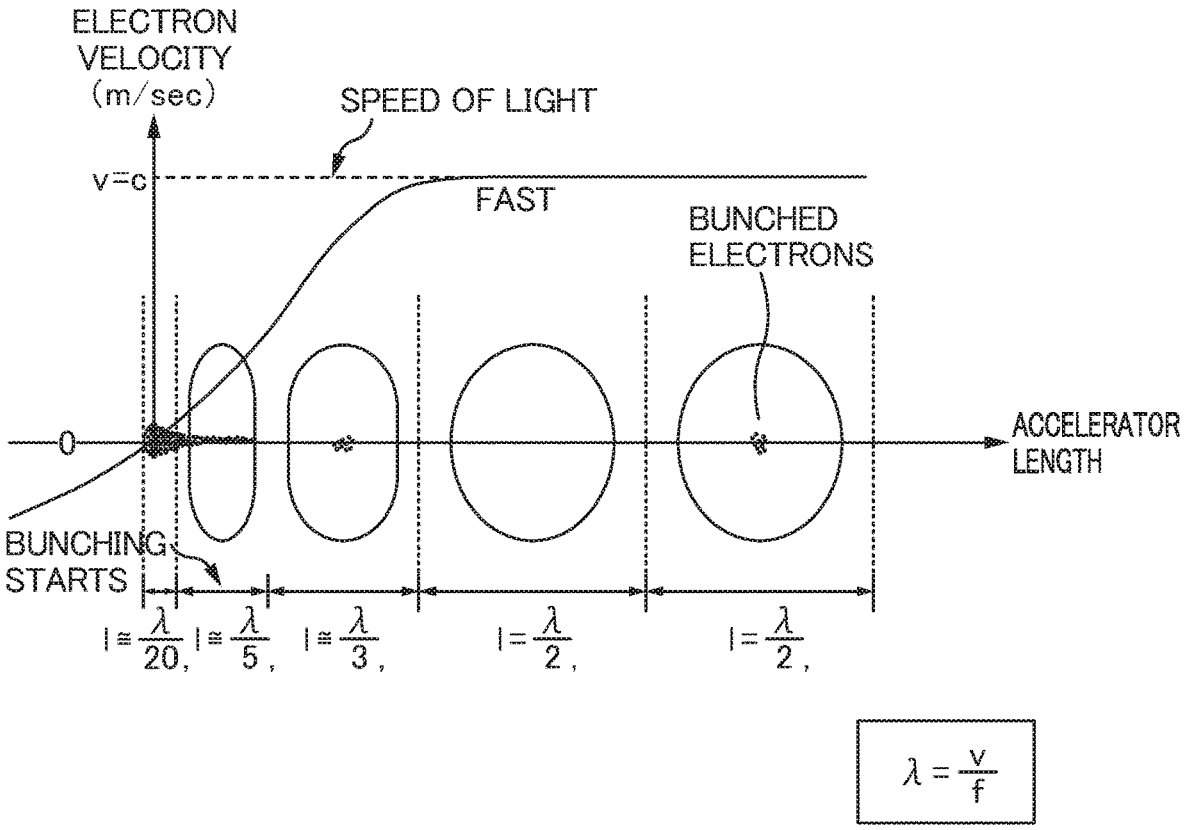
FIG. 5 shows a graph of electron velocity versus electromagnetic field intensity, relative to accelerator length.

FIGS. 4A and 4B are enlarged partial schematic views of the area around the electron gun, in particular the first cavity 316, the pancake cavity 317, and the first accelerator cavity 318 of the accelerator 300 shown in FIG. 3, illustrating electron bunching occurring at time intervals t. Note that the timing of bunching is a function of the wavelength of the rf electromagnetic field, and occurs only at every other accelerator cavity. Thus, bunching at a time t=0 is as illustrated in FIG. 4A, whereas at a time $t=\lambda/2c$ bunching is as illustrated in FIG. 4B.

Note that, as illustrated in FIG. 5, in the present embodiment, the combined length of the first cavity 316 and the pancake cavity 317, where electron bunching starts, is about $\lambda/5$. The length of the first main accelerator cavity 318 then is about $\lambda/3$. The length of the each of the main accelerating cavities 308 is $\lambda/2$. This design provides electromagnetic accelerating fields of gradually increasing strength that enable more of the electrons to be captured and bunched together, in an initially slower but ultimately more efficient way than that of conventional accelerators, which immediately apply a strong and unvarying magnetic field that tends to lose a substantial proportion of electrons. Thus, for example, the graph in FIG. 5 illustrates electron velocity versus electromagnetic field intensity, relative to accelerator cavity length of the accelerator 300 illustrated in FIG. 3. Note in particular the relatively slow electron velocity in the initial part of the accelerator structure, followed by steady acceleration.

With the present embodiment, the beam current accelerated by the accelerator can be as high as approximately 300-350 mA, compared to approximately 100-150 mA for conventional accelerators, assuming a 600 mA electron-injection current from the electron gun, thereby providing an electron capture rate/efficiency of approximately 50-58% compared to about 15-25% for the conventional accelerator. As a result, back-bombardment that damages the electron gun is significantly reduced. Moreover, even those electrons that do backfire are fewer in number than and not as high-energy as is the case conventionally, again limiting damage to the electron gun. In addition, elimination of the prebuncher cavity and separate power feed line and removal of the side-coupled cavity nearest the electron gun simplifies the structure and allows the accelerator device to be shortened by some 3 cm.

The electron gun of the present disclosure requires only about 20 kV of pulsed voltage, somewhat less than the approximately 25 kV typical of conventional accelerators. Thus, in conjunction with the dimensions of the cavities, the intensity of the rf energy accelerating field is about 20 MV/m. The overall length of the accelerator is not particularly limited, but given its assumed medical application is between about 30 cm and 1 meter. The average accelerating electron energy will thus be approximately 6 MeV to 20 MeV.

Figure 7A:
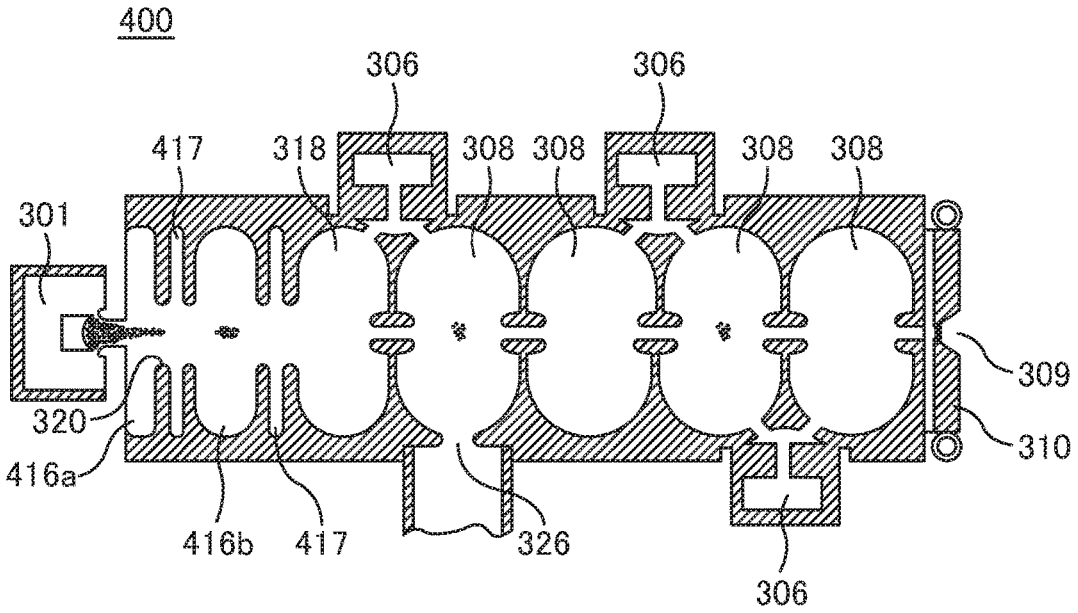
FIG. 7A is a sectional side view of a variation of the embodiment employing multiple accelerator main cavities.
Figure 7B:
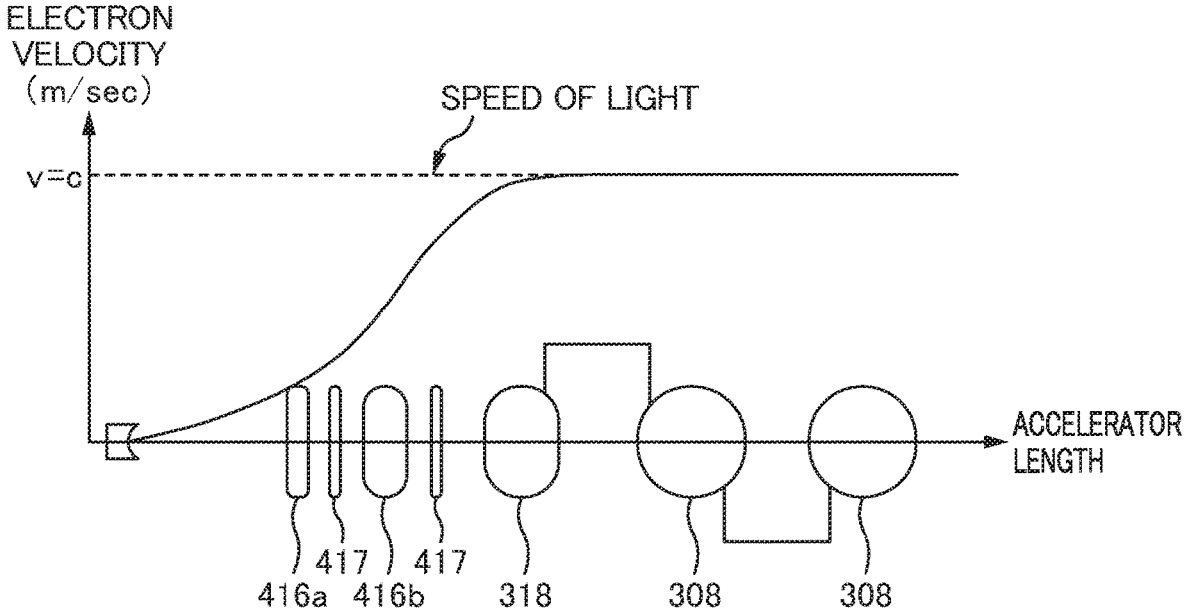
FIG. 7B is a schematic diagram of electron velocity relative to accelerator cavity structure of the variation shown in FIG. 7A.

It should be noted that the larger the total length of the accelerator the greater the energy generated, and the greater the need for multiple accelerator main cavities. FIG. 7A is a sectional side view of a variation of the embodiment employing multiple pancake cavities, and FIG. 7B is a graph that plots electron velocity relative to the corresponding accelerator cavity structure along the longitudinal axis of the accelerator structure shown in FIG. 7A. Note that the effect is the same as that of the embodiment depicted in FIGS. 3-5, illustrating the effects of bunching and accelerating the electrons.

Additional modifications and variations of the above-described embodiment are possible in light of the above teachings. It is therefore to be understood that, within the scope of the appended claims, this disclosure may be practiced otherwise than as specifically described herein.

What is claimed is:

1. A compact standing-wave linear accelerator structure comprising:

an electron gun;

a first cavity axially adjacent to the electron gun, into which electrons are injected directly from the electron gun;

a pancake cavity disposed adjacent to the electron gun on a side of the first cavity opposite the electron gun; and a plurality of accelerator cavities including both on-axis cavities and side-coupled cavities, disposed serially after the pancake cavity, configured to accelerate the electrons injected from the electron gun through a central aperture formed in each of the on-axis cavities, wherein an electromagnetic field is induced in the on-axis cavities by microwave energy applied through apertures connecting the side-coupled cavities to the on-axis cavities, the first cavity and the pancake cavity together functioning as an electron prebuncher and buncher, wherein the compact standing-wave linear accelerator structure has no prebuncher or buncher cavity, and wherein a combined length of the first cavity and the pancake cavity, where electron bunching starts, is about $\lambda/5$, a length of a first of the on-axis cavities is about $\lambda/3$, and a length of said each of the on-axis cavities after the first of the on-axis cavities is about $\lambda/2$, where $\lambda$ is a wavelength of the electromagnetic field induced in the on-axis cavities.

2. The compact standing-wave linear accelerator structure according to claim 1, wherein the plurality of accelerator cavities is coupled together electrically and the side-coupled cavities are coupled to magnetically adjacent said on-axis cavities.

3. The compact standing-wave linear accelerator structure according to claim 1, wherein the plurality of accelerator cavities is coupled together magnetically and the side-coupled cavities are coupled to magnetically adjacent said on-axis cavities.

4. The compact standing-wave linear accelerator structure according to claim 1, wherein a gun voltage is not more than 20 kV.

5. The compact standing-wave linear accelerator structure according to claim 1, wherein a total length of the compact standing-wave linear accelerator structure is between about 30 cm and 1.0 m.

6. The compact standing-wave linear accelerator structure according to claim 1, wherein λ is 10 cm.

7. The compact standing-wave linear accelerator structure according to claim 1, wherein the length of said each of the on axis cavities after the first of the on axis cavities is about 5 cm.

8. A compact standing-wave linear accelerator structure comprising:

an electron gun;

a first cavity axially adjacent to the electron gun;

a plurality of accelerator cavities including both on-axis and side-coupled cavities, disposed serially after the first cavity, and configured to accelerate electrons injected from the electron gun through a central aperture formed in each of the on-axis cavities; and a plurality of pancake cavities, alternating with the on-axis cavities at a distal end of the compact standing-wave linear accelerator structure and adjacent to the electron gun, a first pancake cavity, of the plurality of pancake cavities disposed adjacent to the electron gun on a side of the first cavity opposite the electron gun, and the first cavity together functioning as an electron prebuncher and buncher, wherein a combined length of the first cavity and the first pancake cavity, where electron bunching starts, is about λ/5, a length of a first of the on-axis cavities after the plurality of pancake cavities is about λ/3, and a length of said each of the on-axis cavities after the first of the on-axis cavities is about λ/2, where λ is a wavelength of an electromagnetic field induced in the on-axis cavities.

9. The compact standing-wave linear accelerator structure according to claim 8, wherein the compact standing-wave linear accelerator structure has no prebuncher or buncher cavity.

* * * * *